US005501333A

United States Patent [19]

Swan

[11] Patent Number: 5,501,333

[45] Date of Patent: Mar. 26, 1996

[54] COLLAPSIBLE CONTAINER

[75] Inventor: William E. Swan, Glen Riddle, Pa.

[73] Assignee: Container Research Corporation, Glenn Riddle, Pa.

[21] Appl. No.: 225,526

[22] Filed: Apr. 11, 1994

Related U.S. Application Data

[63] Continuation-in-part of Ser. No. 996,022, Dec. 23, 1992, abandoned.

[51] Int. Cl.[6] ..... B65D 19/00

[52] U.S. Cl. ..... 206/386; 206/600; 206/335; 220/1.5

[58] Field of Search ..... 206/335, 386, 206/598, 600, 589, 590, 593, 594; 220/1.5

[56] References Cited

U.S. PATENT DOCUMENTS

| | | | |
|---|---|---|---|
| 3,023,885 | 3/1962 | Kindseth | 206/594 |
| 3,688,968 | 9/1972 | Rathfon III | 206/335 |
| 3,828,964 | 8/1974 | Bonnot | 220/1.5 |
| 3,968,895 | 7/1976 | Barnes, Jr. et al. | 206/600 |
| 4,294,358 | 10/1981 | Nauheimer et al. | 206/589 |
| 4,503,973 | 3/1985 | Andersson | 206/386 |
| 4,673,087 | 6/1987 | Webb | 206/600 |
| 4,785,957 | 11/1988 | Beck et al. | 206/600 |
| 4,944,404 | 7/1990 | Mead | 206/600 |
| 5,029,734 | 7/1991 | Nichols | 206/386 |
| 5,109,985 | 5/1992 | Rose | 206/600 |
| 5,123,541 | 6/1992 | Giannini et al. | 206/600 |
| 5,133,453 | 7/1992 | Fritze | 216/386 |

*Primary Examiner*—David T. Fidei
*Attorney, Agent, or Firm*—Stuart E. Beck

[57] ABSTRACT

A collapsible container having a base, side wall and a cap. The base includes means for supporting an article to be carried. The side wall is supported on the base and is enclosed by the cap. When the container is collapsed, the cap can engage the base so that a container of reduced size is formed. Further, a side wall for collapsible container is provided where the side wall is comprised of a plurality of sections that are interconnected for relative pivotal movement between adjacent interconnected sections so that they can be folded on each other. The folded sections can be placed on the base, the cap attached, and the collapsed container can be stored or shipped.

8 Claims, 2 Drawing Sheets

COLLAPSIBLE CONTAINER

RELATED APPLICATIONS

This is a continuation in part of application Ser. No. 07/996,022 filed Dec. 23, 1992 for COLLAPSIBLE CONTAINER, now abandoned.

1. Field of the Invention

This invention relates to a container for transporting articles, and more particularly to a container which can be collapsed and reduced in size for shipment when it is empty.

2. Background of the Invention

Shipping containers are advantageously used by manufacturers, shippers and the like to protect the articles which are being shipped. However, after delivery, a problem arises with respect to disposal of the shipping container. Often, these containers are destroyed or discarded because it is easier and less expensive to do that then to attempt any type of recycling.

Further, because of their bulk, returning them to their source is economically infeasible because, even through the containers are now empty, their size assures that substantial fees will be incurred for shipping them.

This is particularly aggravating when shipping bicycles, motorcycles and the like. This it is desirable to ship these items to the retailer or ultimate customer in completely preassembled form. Thus, they can be placed on the showroom and sold with a minimum amount of handling by the retailer.

To a limited extent the problem of containers has been solved by shipping in cardboard. However, this has not proven satisfactory since while cardboard is easily disposed of, the containers do not provide sufficient support and protection for the articles.

It would be desirable to have a shipping container which is made of rigid material such as steel, aluminum, or the like which would hold its shape during shipping and have sufficient strength to protect its contents, while at the same time being readily collapsible to a fraction of its previous size so that it could be easily and readily returned to its source at a cost which would justify doing so.

With the foregoing in mind, the invention relates generally to a collapsible container having a base, side wall and a cap. The base includes means for supporting an article to be carried. The side wall is supported on the base and is enclosed by the cap. When the container is collapsed, the cap can engage the base so that a container that is reduced in size is formed.

In another aspect, the invention relates to a side wall for collapsible container where the side wall is comprised of a plurality of sections that are interconnected by means that permit relative pivotal movement between adjacent interconnected sections so that they can be folded on each other. The sections each have generally the same dimensions so that when they are folded on each other their perimeters are all generally coincident.

A further aspect of the invention relates to a base for a collapsible container of the type that includes a side wall and a cap. The base includes a top surface and a bottom surface. There is a wall between the top and the bottom surfaces that extends generally around the perimeter of the base. The wall defines at least two spaced openings for receiving the forks of a fork lift truck.

In yet another aspect of the invention, a cap is provided for collapsible container that includes a base with an upwardly extending wall extending around its perimeter and a side wall. The cap comprises a generally horizontal member that includes a depending apron. The apron includes means for selectively engaging the side wall or the base.

Still further, the invention relates to a method of making a collapsed container comprising the steps of providing a container having base, side wall and a cap. Means are provided on the base for supporting the side wall and the side wall is are of sufficient size to extend around the base when it is supported by it. The side wall is are placed on the base, and the cap is placed over the base.

In still yet a further aspect, the invention relates to a method of making a large container from a small container. A small container that includes a base with a cap supported thereon is provided. A side wall is provided. Means are provided on the base for supporting an article to be carried in the container and means are provided for supporting the side wall on the base. The cap is removed and the side wall is placed on the base and the cap is then mounted on the side wall.

DETAILED DESCRIPTION OF THE PREFERRED EMBODIMENT

Figure 1:
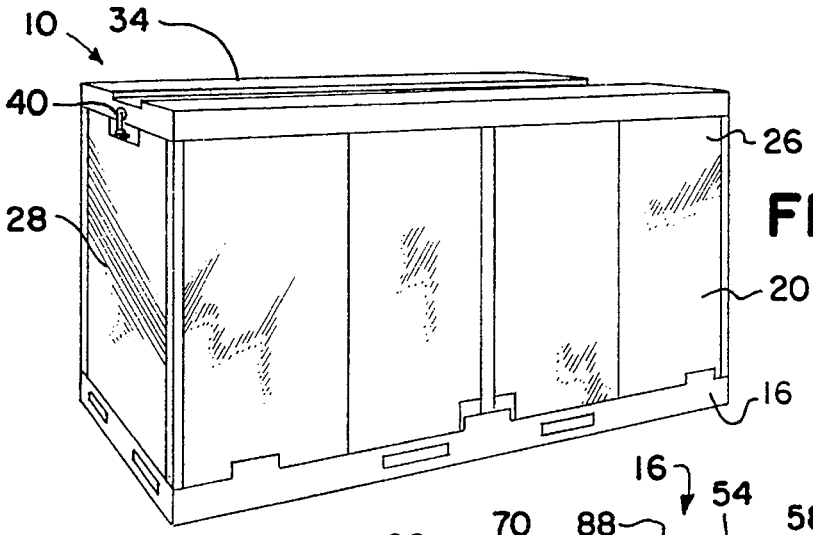
FIG. 1 is a perspective view of one presently preferred form of the invention as used for a shipping container.

Referring to FIG. 1, a container 10 constructed in accordance with a presently preferred form of the invention comprises a base 16 on which is supported side wall 20. The side wall is comprised of two essentially identical sections 26 and 28 which extend around the perimeter of the base 16. A cap 34 is supported on the side wall 20.

Suitable engagement means at each end of the cap 34 such as clip 40 connect the cap to the side wall 20.

Figure 2:
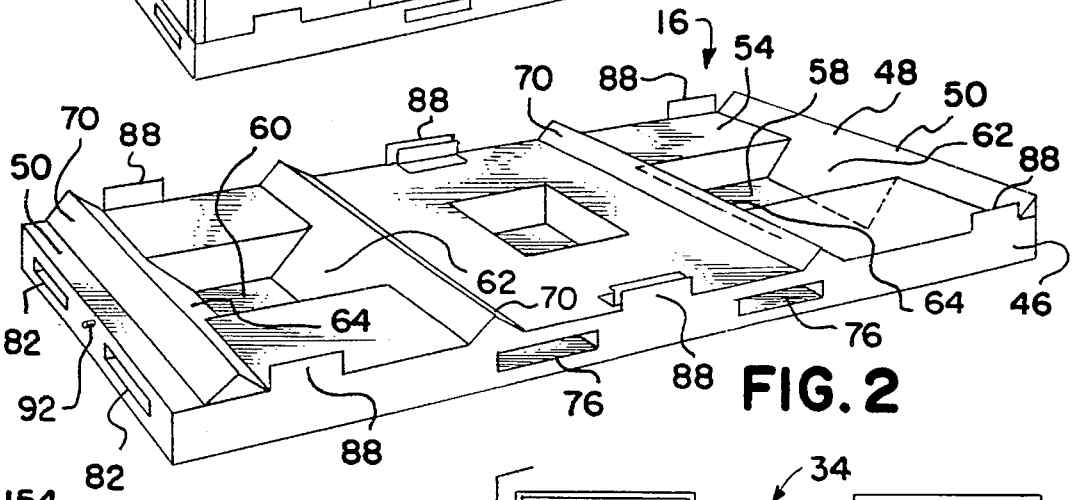
FIG. 2 is a perspective view of the base of the container shown in FIG. 1.

As best seen in FIG. 2, the base 16 comprises an outer wall 46 that defines a perimeter 48. The upper edge of the outer wall 46 at the ends of the base include a generally outwardly facing receptacle 50 (FIG. 3) that is defined by a "G" shaped channel that is supported on the inner face of wall 46. The base 16 includes a generally horizontally disposed upper surface 54 that includes first and second spaced aligned recesses 58 and 60, which are of sufficient depth to receive the wheels of a bicycle, motorcycle or the like. The aligned recesses include forward rearward disposed ramps 62 and 64 that enable a bicycle or motorcycle to be rolled into to and tolled out of the recesses. If desired, a movable tire receiving bed could be placed in one or both of the aligned recesses to more easily accommodate cycles of varying wheel bases.

Figure 3:
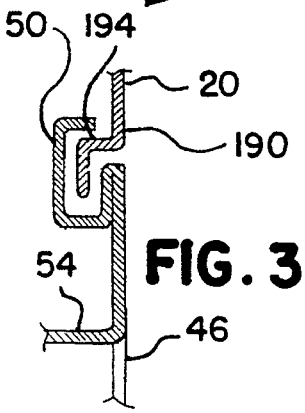
FIG. 3 is a view of a portion of the base of the container shown in FIG. 2.

Cross members 70 which may be angle brackets or folded sheet metal extend transversely across the supper surface 54 at spaced intervals to increase the rigidity of the base. Suitable means 76 and 82 define openings in the outer wall 46 of the base 16 for receiving and engaging the forks of a fork lift truck. The outer wall 46 supports a plurality of guide plates 88 that extend upwardly from horizontal surface 54. As best seen in FIGS. 2 and 3 the outer wall 46 extends upwardly above the horizontal surface 54.

Figure 4:
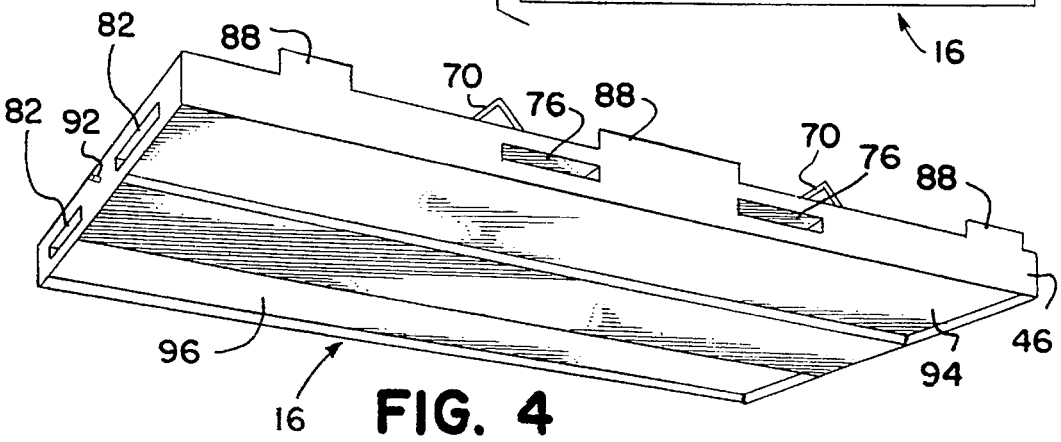
FIG. 4 is a view of the underside of the base of the container shown in FIG. 2.

As seen in FIG. 4, the underside of the base 16 includes two spaced, elongated, longitudinally extending recesses 94 and 96. The recesses 94 and 96 cooperate with complementary means on cap 34 to assist in maintaining the integrity of the containers when they are stacked on each other, such as when they are being shipped or stored.

A suitable connector such as pin 92 extends from each end of the base 16 to engage the clip 40 when the container is collapsed.

Figure 5:
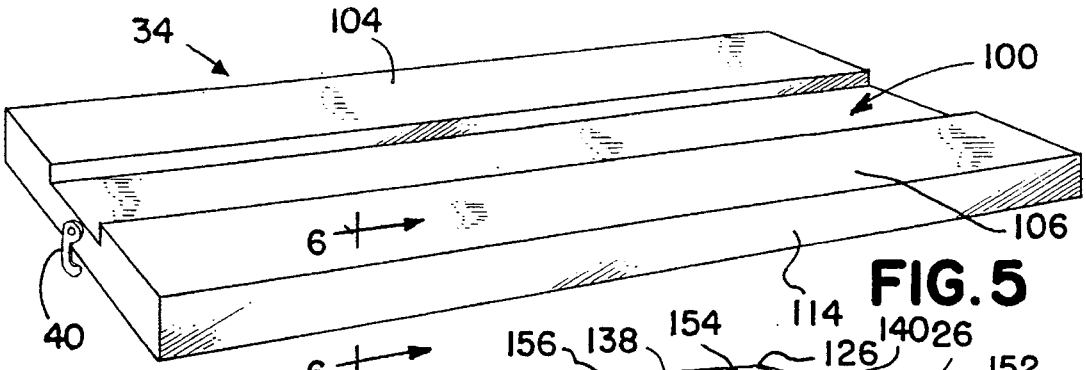
FIG. 5 is a perspective view of the cap of the container shown in FIG. 1.

The cap 16 can best be seen in FIG. 5. It comprises a generally planar upper surface 100 to which may be attached, as by welding, tow elongated, downward facing spaced channels 104 and 106. The channels 104 and 106 increase the rigidity of the cap. They are dimensioned so that they can be nestingly received in the longitudinally extending recesses 94 and 96 on the underside of base 16 when the containers are stacked on each other.

Figure 6:
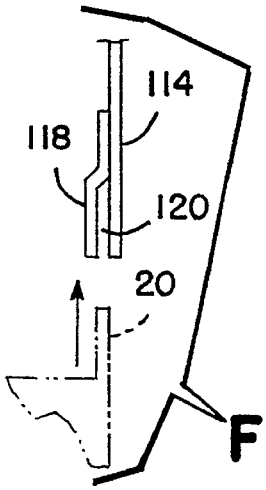
FIG. 6 is a section view taken through lines 6—6 of FIG. 3.

An apron 114 that depends from the upper surface 100 extends around the perimeter of the cap. As best seen in FIG. 6 the interior of the apron 114 includes an inwardly spaced and downward directed liner 118 that with the apron defines a downward directed recess 120 that preferably extends around the perimeter of the cap for engagement with the base 16 or side wall 20.

Figure 7:
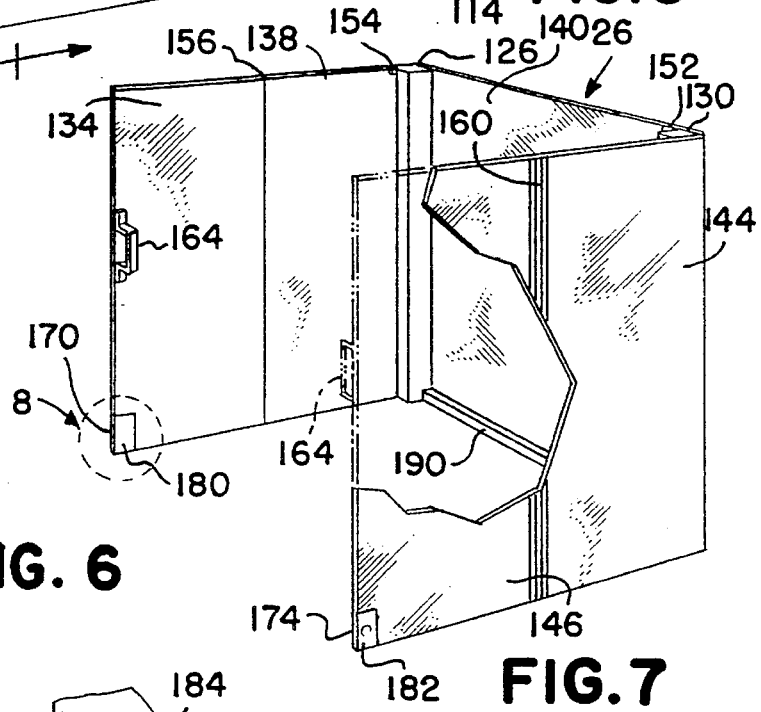
FIG. 7 is a perspective view of a section of the side wall of the container shown in FIG. 1.

Side wall section 26 is illustrated in FIG. 7. It comprises two spaced posts 126 and 130 and a plurality of generally flat, rectangular panels 134, 138, 140, 144 and 146. The posts preferably comprise elongated, rectangular, hollow extrusions of any suitable material such as steel, aluminum or reinforced thermoplastic. The panels may be metal, wood or thermoplastic.

The panels are connected to each other and to the posts 126 and 130 so that they can fold on each other to minimize the space necessary for storing and shipping them.

One of the lateral edges of center panel 140 is fixed to one of the short sides of the post 126 so that there is no relative movement between them. The other lateral edge of center panel 140 is connected to post 130 by a hinge 152. The hinge is located on one of the long walls of the post 130 near its juncture with the adjacent short wall. Thus, post 130 can pivot about hinge 152 so that the aforementioned long wall can lie against the center panel 140 and the length of the side of section 26 comprised of central panel 140 and post 130 can be shortened by a distance that corresponds to the width of the short wall on post 130.

Hinge 154 on post 126 connects one of the lateral edges of panel 138 to post 126. The hinge 154 is located on one of the short walls of the post 126 near its juncture with the adjacent long wall. The other lateral edge of the panel 138 is pivotally connected by hinge 156 to the adjacent lateral edge of panel 134.

One of the lateral edges of panel 144 is fixed to one of the long sides of post 130 for movement with it. The other lateral edge of panel 144 is pivotally connected by hinge 160 to the adjacent lateral edge of panel 146.

Figure 8:
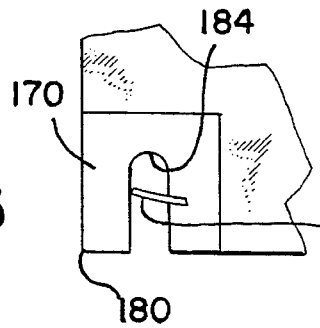
FIG. 8 is an enlarged detail of a of a portion of FIG. 7.
Figure 11:
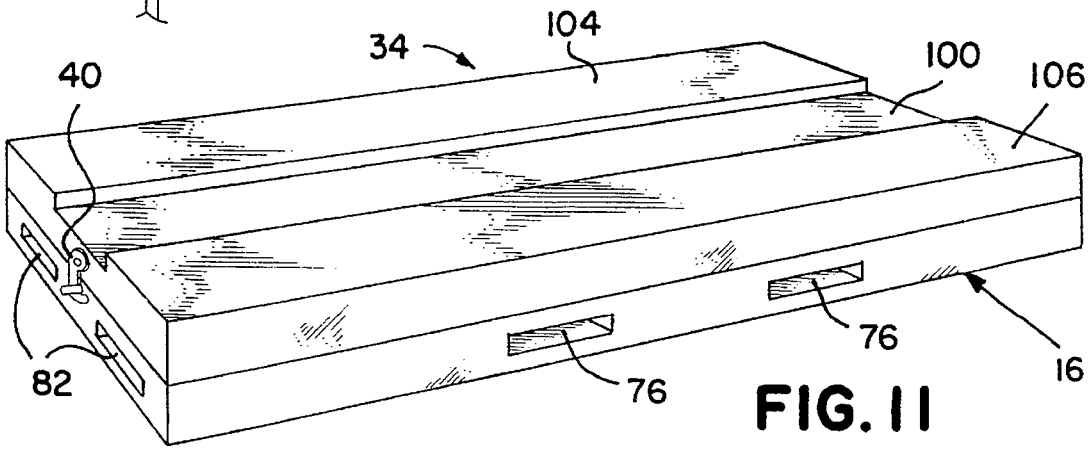
FIG. 11 is a perspective view of the container after it has been collapsed.

Panels 134 and 146 include mutually facing handles 164 at their edges that are spaced from hinges 156 and 160. At the distal comer 170 and 174 of panels 134 and 146 are located locking brackets 180 and 182. Each of the brackets 180 and 182 includes an inverted "U" shaped recess 184 (FIG. 8). One end of an arm 186 is pivotally connected to the bracket at one side of the recess. Due to its weight, the arm 186 normally lies across the opening defined by the recess. However, it can be easily pivoted upward and out of the way to permit a complementary locking member on the base to enter and be released from the recess 184.

The container 10 is assembled by placing each of the side wall sections 26 and 28 over the base. As best seen in FIG. 3 the lower portion 190 of panel 140 comprises an inwardly directed generally "Z" shaped flange 194. The flange 194 is adapted to be received in the outwardly facing receptacle 50 on the inner face of side wall 46.

The lower portions of panels 134, 138, 144 and 146 are supported on the horizontal surface 54 and are disposed between the cross members 70 and the inner faces of brackets 88. Suitable pins (not shown) that are mounted on each side of the base are adapted to slide into the "U" shaped openings 184 in the locking brackets 180 and 182 in the distal comers 170 and 174 to prevent the side wall sections 26 and 28 from rotating out of engagement with the base.

The cap 34 is then placed over the side wall 20 with its upper edges being received in downward facing recess 120. The cap can then be connected to the side wall 20 by clip 40 and can be further secured by straps which may be wrapped around the assembled container.

The container 10 can house any article which can be confined within its side wall, cap and base. It is especially useful for transporting bicycles, motorcycles or the like because the front and rear wheels of those types of vehicles can be readily received in and supported by the spaced aligned recesses 58 and 60. They can easily be rolled into and be removed from the recesses by virtue of the forward and rear ramps 62 and 64 associated with each of the recesses 58 and 60.

After the article has been shipped to a desired location, the container can be readily collapsed to a fraction of its former size for efficient and relatively inexpensive return.

Collapsing the container comprises removing the cap 34 and releasing locking brackets 180 and 182 from their respective connectors on the base so that the side wall sections 26 and 28 can be removed. Panel 144 and post 130 can then be pivoted about hinge 152 so that they lie close against center panel 140. Panel 146 can then be pivoted about hinge 160 so that it overlies panel 144.

Figure 9:
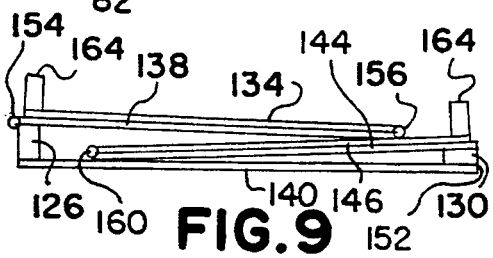
FIG. 9 is an end elevation view of the section of side wall shown folded.

As seen FIG. 9 the panels 144 and 145 are not wide enough to reach post 126.

Panel 138 is then pivoted about hinge 154 onto panel 146. Then panel 134 is pivoted about hinge 156 so that it overlies panel 138.

Figure 10:
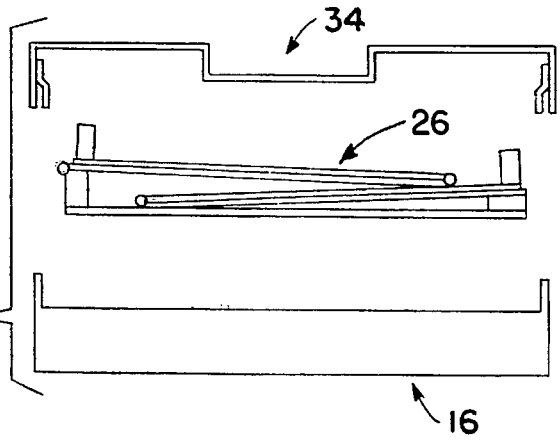
FIG. 10 is a end elevation view of the collapsed container with the cap being lowered onto the base.

As seen in FIGS. 9 and 10 the location of hinges 152 and 154 relative to posts 126 and 130 and center panel 140 permits the side wall sections to be folded so that the panels when stacked on each other lie within the perimeter of the base. The handles 164 lie in easy reach for later use.

Then, as illustrated in FIG. 10,the cap 34 is lowered over the collapsed panels which have been placed on the base 16. The apron 114 and liner 118 are disposed between the cross members 70 and the inner faces of brackets 88. The clip 40 may the be connected to the pin 92 to fasten the cap to the base.

Since the collapsed container is now only a fraction of its former size, it is convenient to stack several such containers on each other for storage and shipping. Stacking is greatly assisted because, as explained earlier, the channels 104 and 106 on the top of base 34 can engage the complimentary receptacles on the bottom of the base so that the containers can be stacked without fear of the upper ones sliding from the lower ones.

Thus, a collapsible container has been described which is useful for shipping bicycles, motorcycles or other items and which can be collapsed to a fraction of its size for return shipping. Further, there have been shown advantageous structures which can be used for the base, side wall and cap of the container and a method for erecting, collapsing and stacking the container.

While the invention has been described with reference to a particular form, it is apparent that other forms will be obvious to those skilled in the art. Thus, the scope of the invention should not be limited by the foregoing description, but, rather only by the scope of the appended claims.

I claim:

1. A collapsible container comprising a base, side wall, and a cap;

said base including a horizontally disposed member that defines a perimeter, said horizontally disposed member comprising means for supporting an article to be carried, means on said base for engaging and supporting said side wall, said last named means being located on said perimeter of said base;

said side wall being comprised of two sets of sections with each of said sets including three sections that are interconnected by hinges and two spaced posts that are rectangular in cross section;

at least one of said posts in each of said sets of being fixed to said center section along the edge of said center section adjacent a second section of said sets so that said post moves with said center section, said post being hingedly connected to said second section of said set; the other of said posts being hingedly connected to said center section along the edge of said center section adjacent said third section of said set, said other post being fixed to said third section of said set for movement with said third section; each of said sections being dimensioned so that said sections can lie on said base and be within the area defined by said perimeter; and said cap comprises a generally horizontal member that includes a depending apron, said apron including means for selectively engaging said side wall or said base.

2. A collapsible container comprising a base, side wall, and a cap;

said base including a horizontally disposed member that defines a perimeter, means on said perimeter for engaging and supporting said side wall;

said base including a top surface and a bottom surface; said top surface including at least two aligned recesses for receiving a part of the article that is to be supported on said base and carried in said collapsible container;

said side wall being comprised of a plurality of sections, some of said sections, being hinged to others of said sections, said sections being dimensioned so that they can pivot about said hinges and lie on said base within the area defined by said perimeter; and said cap comprising a generally horizontal member that includes a depending apron, said apron including means for selectively engaging said side wall or said base.

3. A collapsible container comprising a base, side wall, and a cap;

said base including a horizontally disposed member that defines a perimeter, said horizontally disposed member comprising means for supporting an article to be carried, said side wall being comprised of a plurality of sections, each of said sections being dimensioned so that said sections can lie on said base and be within the area defined by said perimeter;

mutually engaging means on said perimeter and on said side wall for engaging and supporting said side wall on said base, said mutually engaging means on said side wall including a generally "Z" shaped member connected to and extending inwardly and downwardly from at least a portion of one of said sections, and said mutually engaging means on said base includes a generally "C" shaped member, said "C" shaped member located within the perimeter of said base and facing outwardly to releasably receive the downwardly extending portion of said "Z" shaped member, and said cap comprising a generally horizontal member that includes a depending apron, said apron including means for selectively engaging said side wall or said base.

4. A collapsible container comprising a base, side wall, and a cap;

said base including a horizontally disposed member that defines a perimeter, said horizontally disposed member comprising means for supporting an article to be carried, means for engaging and supporting said side wall on said base, a locking member on said base, a downward facing recess defined by said side wall;

means pivotally connected to said side wall for releasably closing said recess;

said locking member on said base being received in said recess and being engaged by said pivotal means for releasably closing said recess thereby to retain said side wall in engagement with said base;

said pivotal means for releasably closing said recess being operative to release said locking member;

said side wall being comprised of a plurality of sections, each of said sections being dimensioned so that they can lie on said base within the area defined by said perimeter; and said cap comprising a generally horizontal member that includes a depending apron, said apron including means for selectively engaging said side wall or said base.

5. A collapsible container as defined in claim 4 wherein at least some of said sections comprise a plurality of panels, and hinges for interconnecting come of said panels for relative pivotal movement.

6. A collapsible container as defined in claim 1 wherein said second and third sections of said side wall each comprise at least two panels, and means for connecting said panels in each of said sections to each other for relative pivotal movement.

7. A collapsible container as defined in claim 6 wherein said center section and each of said panels in said second and third sections are dimensioned so that they can lie on said base and be within the area defined by said perimeter.

8. A collapsible container as defined in claim 4 wherein said locking member includes a laterally extending pin.

* * * * *